US011129264B2

(12) United States Patent
Ishii et al.

(10) Patent No.: US 11,129,264 B2
(45) Date of Patent: Sep. 21, 2021

(54) X-RAY GENERATOR

(71) Applicant: HAMAMATSU PHOTONICS K.K., Hamamatsu (JP)

(72) Inventors: Atsushi Ishii, Hamamatsu (JP); Akihito Kobayashi, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 17/040,140

(22) PCT Filed: Feb. 18, 2019

(86) PCT No.: PCT/JP2019/005897

§ 371 (c)(1),
(2) Date: Sep. 22, 2020

(87) PCT Pub. No.: WO2019/198338

PCT Pub. Date: Oct. 17, 2019

(65) Prior Publication Data

US 2021/0029809 A1 Jan. 28, 2021

(30) Foreign Application Priority Data

Apr. 12, 2018 (JP) ..... JP2018-076996

(51) Int. Cl.
*H05G 1/06* (2006.01)
*H01J 35/16* (2006.01)
(Continued)

(52) U.S. Cl.
CPC ..... *H05G 1/06* (2013.01); *H01J 35/16* (2013.01); *H05G 1/025* (2013.01); *H05G 1/26* (2013.01)

(58) Field of Classification Search
CPC ..... H01J 35/16; H05G 1/06; H05G 1/025
See application file for complete search history.

(56) References Cited

U.S. PATENT DOCUMENTS

2005/0190884 A1* 9/2005 Suzuki ..... H05G 1/06 378/101
2005/0190886 A1* 9/2005 Yoshiyama ..... H05G 1/06 378/123

(Continued)

FOREIGN PATENT DOCUMENTS

JP H06-005382 A 1/1994
JP H09-027394 A 1/1997

(Continued)

OTHER PUBLICATIONS

International Preliminary Report on Patentability dated Oct. 22, 2020 for PCT/JP2019/005897.

*Primary Examiner* — Chih-Cheng Kao
(74) *Attorney, Agent, or Firm* — Faegre Drinker Biddle & Reath LLP

(57) ABSTRACT

An X-ray generator includes an X-ray tube, an X-ray tube accommodation portion, and a power source unit having an internal substrate supplying a voltage to the X-ray tube sealed inside an insulating block. A first space is defined by an upper surface of the insulating block and an inner surface of the X-ray tube accommodation portion. A second space is defined by a recess portion opening to the outside formed on a side surface of the insulating block and a sealing member sealing an opening of the recess portion. A communication hole causing the first space and the second space to communicate with each other is provided in the insulating block. Insulating oil is enclosed in the first space and the second space. A depth of the recess portion is smaller than a width of the recess portion.

9 Claims, 8 Drawing Sheets

(51) Int. Cl.
*H05G 1/26* (2006.01)
*H05G 1/02* (2006.01)

(56) References Cited

U.S. PATENT DOCUMENTS

| | | | | |
|---|---|---|---|---|
| 2019/0318902 | A1* | 10/2019 | Ishii | H05G 1/06 |
| 2021/0100088 | A1* | 4/2021 | Ishii | H05G 1/06 |

FOREIGN PATENT DOCUMENTS

| | | | |
|---|---|---|---|
| JP | H09-245702 | A | 9/1997 |
| JP | 2003-168592 | A | 6/2003 |
| JP | 2004-213974 | A | 7/2004 |
| JP | 2007-066655 | A | 3/2007 |
| JP | 4549554 | B2 | 9/2010 |

* cited by examiner

X-RAY GENERATOR

TECHNICAL FIELD

An aspect of the present disclosure relates to an X-ray generator.

BACKGROUND ART

In the related art, regarding an X-ray generator including an X-ray tube, a structure in which an X-ray tube accommodation portion accommodating the X-ray tube together with insulating oil is fixed to an insulating block having a sealed power source unit is known (for example, refer to Patent Literature 1). Due to this structure, both insulating characteristics and heat dissipation characteristics with respect to the X-ray tube can be achieved, and thus a highly stable X-ray generator can be obtained.

CITATION LIST

Patent Literature

[Patent Literature 1] Japanese Unexamined Patent Publication No. 2004-213974

SUMMARY OF INVENTION

Technical Problem

It is desired that the foregoing X-ray generator be further improved in stability. Therefore, it is preferable to provide a configuration for improving and/or retaining insulating characteristics or heat dissipation characteristics of insulating oil. However, in a structure in which such a configuration is provided inside an X-ray tube accommodation portion in a manner of facing an X-ray tube, disturbance may occur in an electric field inside the X-ray tube accommodation portion due to this configuration. Further, there is concern that discharging may occur due to this disturbance in an electric field. Meanwhile, it is conceivable that this configuration be provided on an insulating block side. However, since a power source unit is sealed in the insulating block, there is concern that discharging may occur between this configuration and the power source unit unless this point is taken into consideration.

Here, an object of an aspect of the present disclosure is to provide an X-ray generator in which occurrence of discharging can be curbed.

Solution to Problem

According to an aspect of the present disclosure, there is provided an X-ray generator including an X-ray tube configured to generate X-rays, an X-ray tube accommodation portion which accommodates at least a part of the X-ray tube such that at least the part of the X-ray tube is surrounded when viewed in a tube axis direction of the X-ray tube, and a power source unit disposed at a position facing the X-ray tube in the tube axis direction and having a high-voltage generation circuit supplying a voltage to the X-ray tube sealed inside a solid insulating block made of an insulative material. A first space is defined by a first surface of the insulating block facing the X-ray tube and an inner surface of the X-ray tube accommodation portion. A second space is defined by a recess portion opening to an outside formed on a second surface of the insulating block different from the first surface and a sealing member sealing an opening of the recess portion. A communication portion causing the first space and the second space to communicate with each other is provided in the insulating block. An insulating liquid is enclosed in the first space and the second space. A depth of the recess portion is smaller than a width of the recess portion in a longitudinal direction orthogonal to a depth direction of the recess portion.

In the X-ray generator according to the aspect of the present disclosure, the insulating block includes the second space defined by the recess portion opening to the outside formed on the second surface different from the first surface defining the first space, and this second space communicates with the first space through the communication portion. Accordingly, the space enclosing (filled with) the insulating liquid opens in a region not facing the X-ray tube accommodation portion. Thus, in this recess portion, a configuration for improving and/or retaining insulating characteristics or heat dissipation characteristics of the insulating liquid can be disposed. Therefore, occurrence of disturbance in an electric field inside the X-ray tube accommodation portion due to this configuration can be curbed, and discharging caused by this disturbance in an electric field can be curbed.

In addition, since the insulating liquid filling the first space and the second space comes into direct contact with the X-ray tube, it is exposed to a state at a high temperature. Due to such causes, insulating properties of this insulating liquid are more likely to deteriorate than those of the solid insulating block. In this manner, if the distance between a space (second space) inside the recess portion filled with a liquid of which insulating properties are likely to deteriorate and the high-voltage generation circuit is short, there is a high degree of concern that voltage endurance characteristics of the insulating block on the second space side with respect to a high voltage generated by the high-voltage generation circuit may deteriorate and discharging may occur toward the second space side. Meanwhile, in the X-ray generator, the depth of the recess portion is smaller than the width of the recess portion in the longitudinal direction. That is, the shape of the recess portion is a flat shape. Accordingly, the distance between the high-voltage generation circuit sealed inside the insulating block and the second space can be secured to be as long as possible. That is, the thickness of the solid insulating block interposed between the high-voltage generation circuit and the second space can be secured to be as thick as possible. As a result, occurrence of discharging described above can also be curbed effectively.

The communication portion may be a communication hole formed inside the insulating block in a manner of opening to the first surface and the recess portion. According to this configuration, a communication structure having high air-tightness can be constituted inside the insulating block.

On the first surface of the insulating block, a connection portion electrically connecting the X-ray tube and the power source unit to each other may be disposed, and a projecting portion made of an insulative material and protruding in the tube axis direction such that the connection portion is surrounded when viewed in the tube axis direction may be formed. An opening of the communication portion on the first surface side may be provided on an outward side of the projecting portion when viewed in the tube axis direction. In this case, due to the projecting portion, the opening of the communication portion on the first surface side which may cause disturbance in an electric field can be isolated from the connection portion which is likely to become an origin of discharging. As a result, occurrence of discharging in this opening can be curbed effectively.

An opening surface of the recess portion may have a rectangular shape. The depth of the recess portion may be smaller than a length of any side of the opening surface. In this configuration, while the depth of the recess portion can be as shallow as possible, the volume required for the second space can be ensured by increasing the area of the opening surface as much as possible.

The sealing member may be a member capable of being deformed in accordance with a change in volume of the insulating liquid enclosed in the first space and the second space. According to this configuration, a change in volume which has occurred due to a change in temperature of the insulating liquid can be absorbed by the sealing member. Accordingly, a change in internal pressure inside the first space accommodating the X-ray tube can be curbed.

A cooling unit for cooling the insulating liquid may be disposed in the second space. According to this configuration, the insulating liquid at a high temperature due to heat absorbed from the X-ray tube or the like can be cooled efficiently by the cooling unit.

A heating unit for heating the insulating liquid may be disposed in the second space. According to this configuration, when it is desired that the temperature of the insulating liquid be raised to a certain temperature, or the like, in order to stabilize operation of the X-ray tube at the time of starting the X-ray generator or the like, the insulating liquid can be heated efficiently by the heating unit.

A sensor measuring a temperature of the insulating liquid may be disposed in the second space. According to this configuration, since the temperature of the insulating liquid can be measured by the sensor, the temperature of the insulating liquid is easily managed.

A second recess portion different from the recess portion opening to the outside may be formed on a surface different from the first surface of the insulating block. A second communication portion causing a space defined by the second recess portion and the first space to communicate with each other may be provided in the insulating block. The sealing member may be a circulation pump configured to seal the opening of the recess portion, seal an opening of the second recess portion, and discharge the insulating liquid suctioned from one of the recess portion and the second recess portion to the other of the recess portion and the second recess portion. According to this configuration, since the insulating liquid can circulate between the circulation pump and the first space, cooling efficiency of the X-ray tube can be improved by generating a convective flow of the insulating liquid inside the first space. In addition, it is easy to perform control such that the temperature of the insulating liquid inside the first space is maintained to be uniform by cooling or heating the insulating liquid in the circulation pump.

Advantageous Effects of Invention

According to the aspect of the present disclosure, it is possible to provide an X-ray generator in which occurrence of discharging can be curbed.

DESCRIPTION OF EMBODIMENT

Figure 1:
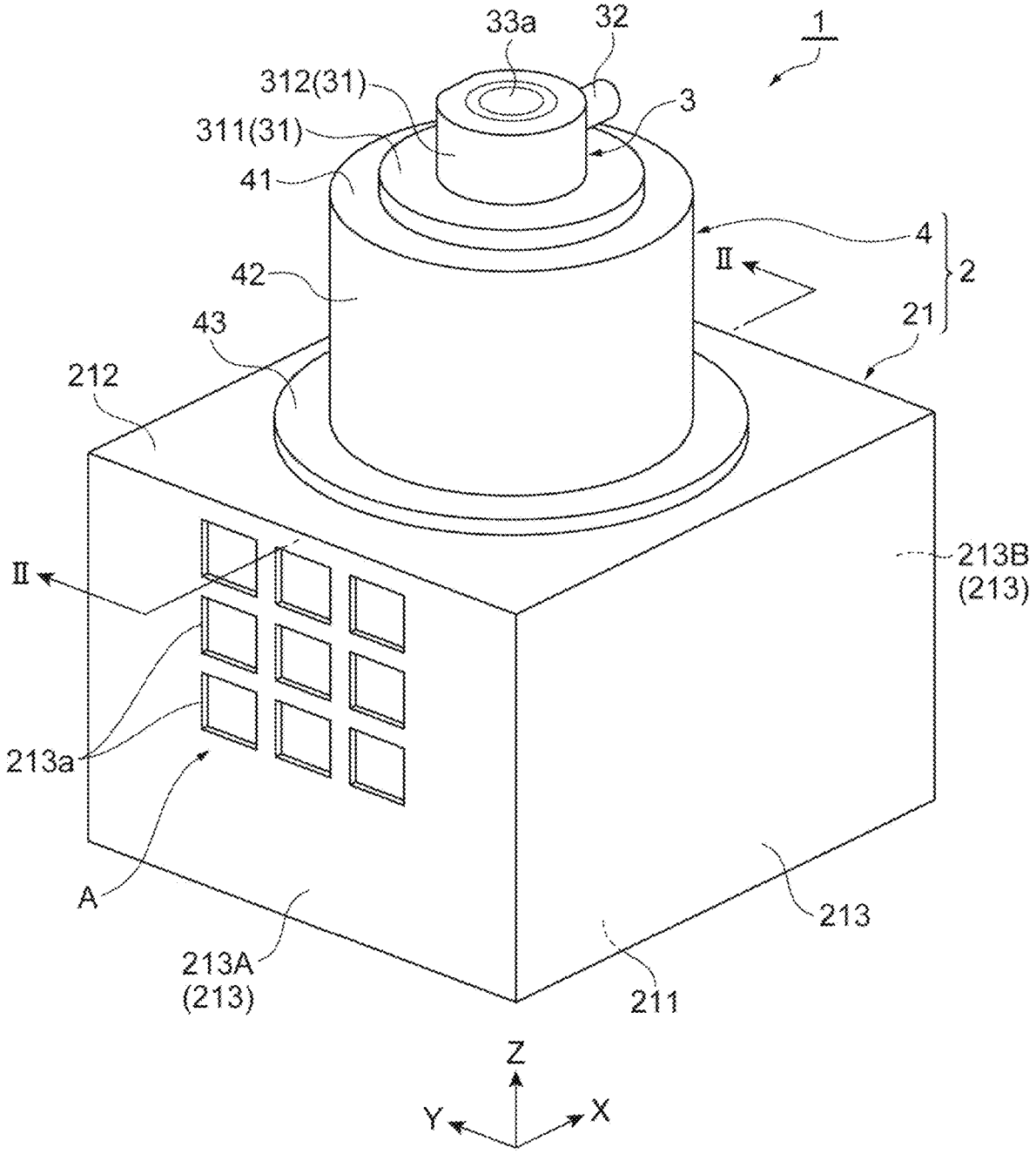
FIG. 1 is a perspective view showing an appearance of an X-ray generator of an embodiment.

Hereinafter, an embodiment of the present disclosure will be described in detail with reference to the drawings. The same reference signs are applied to parts which are the same or corresponding in each diagram, and duplicate description will be omitted. In addition, words indicating predetermined directions, such as "upward" and "downward", are based on the states shown in the drawings and are used for the sake of convenience.

Figure 2:
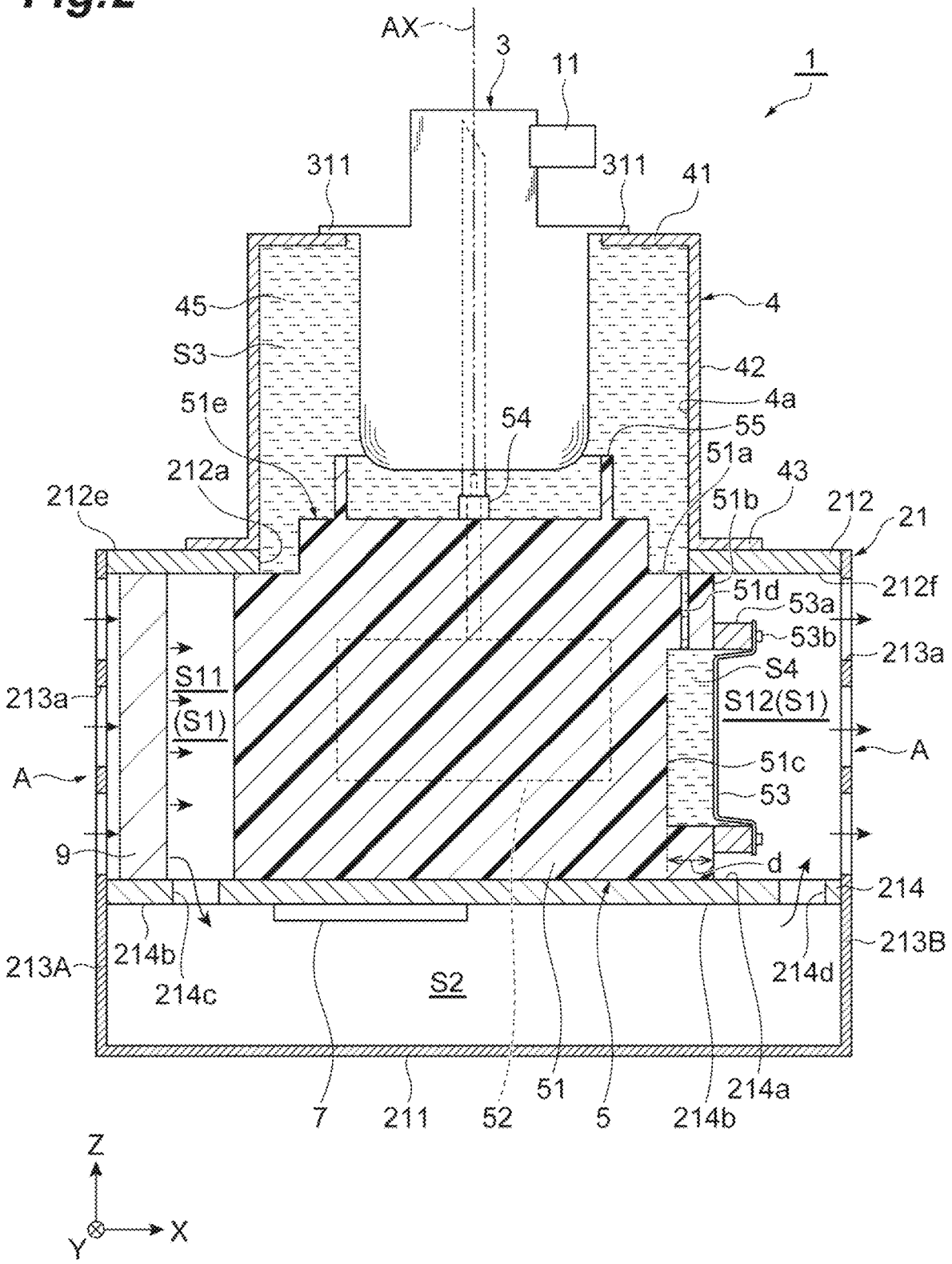
FIG. 2 is a cross-sectional view along line II-II in FIG. 1.

FIG. 1 is a perspective view showing an appearance of an X-ray generator according to the embodiment of the present disclosure. FIG. 2 is a cross-sectional view along line II-II in FIG. 1. For example, an X-ray generator 1 shown in FIGS. 1 and 2 is a micro-focus X-ray source used in a non-destructive X-ray test in which an internal structure of a test object is observed. The X-ray generator 1 has a casing 2. Inside the casing 2, an X-ray tube 3 generating X-rays and a power source unit 5 supplying power to the X-ray tube 3 are mainly accommodated. The casing 2 has an X-ray tube accommodation portion 4 accommodating a part of the X-ray tube 3, and an accommodation portion 21.

The accommodation portion 21 is a part mainly accommodating the power source unit 5. The accommodation portion 21 has a bottom wall portion 211, an upper wall portion 212, and side wall portions 213. Each of the bottom wall portion 211 and the upper wall portion 212 has a substantially square shape. Edge portions of the bottom wall portion 211 and edge portions of the upper wall portion 212 are joined to each other with four side wall portions 213 therebetween. Accordingly, the accommodation portion 21 is formed to have a substantially rectangular parallelepiped shape. In the present embodiment, for the sake of convenience, a direction in which the bottom wall portion 211 and the upper wall portion 212 face each other will be defined as a Z direction, the bottom wall portion 211 side will be defined as a downward side, and the upper wall portion 212 side will be defined as an upward side. In addition, directions which are orthogonal to the Z direction and in which the side wall portions 213 facing each other face each other will be referred to as an X direction and a Y direction, respectively. In a central portion of the upper wall portion 212 viewed in the Z direction, an opening portion 212*a* (circular penetration hole) is provided.

An intermediate wall portion 214 is provided between the bottom wall portion 211 and the upper wall portion 212 at a position away from both the bottom wall portion 211 and the upper wall portion 212. Due to such an intermediate wall portion 214, inside the accommodation portion 21, a first accommodation space S1 surrounded by the upper wall portion 212, the side wall portions 213, and the intermediate wall portion 214; and a second accommodation space S2 surrounded by the bottom wall portion 211, the side wall portions 213, and the intermediate wall portion 214 are defined. In the first accommodation space S1, the power source unit 5 is fixed to an upper surface 214*a* of the intermediate wall portion 214. In the second accommodation space S2, a control circuit substrate 7 is attached to a lower surface 214*b* of the intermediate wall portion 214. A control circuit for controlling operation of each of the units and the portions (for example, the power source unit 5, a blower fan 9 (which will be described below), and an electron gun 11 (which will be described below)) of the X-ray generator 1 using various kinds of electronic components (not shown in the diagram) is constituted on the control circuit substrate 7.

The X-ray tube accommodation portion 4 is formed of a metal having high heat conductivity (high heat dissipation). Examples of a material of the X-ray tube accommodation portion 4 include aluminum, iron, copper, and an alloy including these. In the present embodiment, the material of the X-ray tube accommodation portion 4 is aluminum (or an alloy thereof). The X-ray tube accommodation portion 4 has a tubular shape having openings on both ends of the X-ray tube 3 in a tube axis direction (Z direction). A tube axis of the X-ray tube accommodation portion 4 coincides with a tube axis AX of the X-ray tube 3. The X-ray tube accommodation portion 4 has a holding portion 41, a cylindrical portion 42, and a flange portion 43. The holding portion 41 is a part holding the X-ray tube 3 in a flange portion 311 using a fixing member (not shown in the diagram) and air-tightly seals the X-ray tube 3 together with an upper opening of the X-ray tube accommodation portion 4. The cylindrical portion 42 is a part connected to a lower end of the holding portion 41 and formed to have a cylindrical shape including a wall surface extending in the Z direction. The flange portion 43 is a part connected to an end portion of the cylindrical portion 42 and extending to the outward side when viewed in the Z direction. The flange portion 43 is air-tightly fixed to an upper surface 212*e* of the upper wall portion 212 at a position surrounding the opening portion 212*a* of the upper wall portion 212 when viewed in the Z direction. In the present embodiment, the flange portion 43 is thermally connected to the upper surface 212*e* of the upper wall portion 212 (comes into contact with the upper surface 212*e* of the upper wall portion 212 in a thermally conductive manner). Insulating oil 45 (electrically insulating liquid) is air-tightly enclosed inside the X-ray tube accommodation portion 4 (fills the inside of the X-ray tube accommodation portion 4).

The power source unit 5 is a part supplying power within a range of approximately several kV to several hundreds of kV to the X-ray tube 3. The power source unit 5 has an insulating block 51 made of a solid epoxy resin and having electrical insulating properties, and an internal substrate 52 including a high-voltage generation circuit molded inside the insulating block 51. The insulating block 51 is formed to have a substantially rectangular parallelepiped shape. A recess portion 51*c* forming a space having a substantially rectangular parallelepiped shape opening to the outside is provided on a side surface 51*b* of the insulating block 51. An upper surface central portion of the insulating block 51 penetrates the opening portion 212*a* of the upper wall portion 212 and protrudes. Meanwhile, an upper surface edge portion 51*a* of the insulating block 51 is air-tightly fixed to a lower surface 212*f* of the upper wall portion 212. A high-voltage power supply unit 54 including a cylindrical socket electrically connected to the internal substrate 52 is disposed on the upper surface central portion of the insulating block 51. The power source unit 5 is electrically connected to the X-ray tube 3 via the high-voltage power supply unit 54.

The outer diameter of a protrusion part (that is, the upper surface central portion) of the insulating block 51 inserted through the opening portion 212*a* is the same as or slightly smaller than the inner diameter of the opening portion 212*a*. In addition, a communication hole 51*d* which is a penetration hole extending toward the recess portion 51*c* is formed on the upper surface edge portion 51*a* of the insulating block 51. A filling space S3 which is an internal space (a space surrounded by the X-ray tube accommodation portion 4, the X-ray tube 3, and the insulating block 51, that is, a space enclosing the insulating oil 45) of the X-ray tube accommodation portion 4 communicates with the recess portion 51*c* through the communication hole 51*d*. Accordingly, after the X-ray tube 3 is fixed to the X-ray tube accommodation portion 4 and the upper opening of the X-ray tube accommodation portion 4 is closed, the insulating oil 45 can be injected into the internal space (filling space S3) of the X-ray tube accommodation portion 4 from the recess portion 51*c* of the insulating block 51. An opening of the recess portion 51*c* is sealed by a sealing member 53 in a state in which the insides of the internal space (filling space S3) of the X-ray tube accommodation portion 4, the communication hole 51*d*, and the recess portion 51*c* are filled with the insulating oil 45. For example, the sealing member 53 is a lid member made of an insulative material capable of being elastically deformed and functions as a diaphragm. According to such a sealing member 53, a change in volume which has occurred due to a change in temperature of the filled insulating oil 45 can be absorbed, and fluctuation in internal pressure in the internal space (filling space S3) of the X-ray tube accommodation portion 4 can be curbed.

In the present embodiment, a ventilation hole portion A is provided in each of side wall portions 213A and 213B facing each other in the X direction. A plurality of ventilation holes 213*a* causing the first accommodation space S1 and the outside to communicate with each other are provided in the ventilation hole portion A. The blower fan 9 is provided on the inward side of the side wall portion 213A on one side. The blower fan 9 efficiently cools each of the units and the portions such as the power source unit 5 and the control circuit substrate 7 utilizing a space configuration formed inside the casing 2.

Specifically, the blower fan 9 generates cooling gas by taking in outside air through the ventilation hole portion A provided in the side wall portion 213A and blows this cooling gas to a space S11, of the first accommodation space S1, between the side wall portion 213A and the power source unit 5. The power source unit 5 is cooled by cooling gas blowing into the space S11. A gap may be provided or no gap may be provided between a side surface of the power source unit 5 and the side wall portions 213 of the accommodation portion 21 facing each other in the Y direction. When a gap is provided, the power source unit 5 can be cooled more effectively by cooling gas passing through this gap (that is, cooling gas circulating from the space S11 to a space S12 through this gap).

An opening portion 214*c* causing the space S11 and the second accommodation space S2 to communicate with each other and an opening portion 214*d* causing the space S12 and the second accommodation space S2 to communicate with each other are formed in the intermediate wall portion 214. Accordingly, a part of cooling gas circulating inside the space S11 flows into the second accommodation space S2 through the opening portion 214*c* of the intermediate wall portion 214. The control circuit substrate 7 is cooled due to cooling gas which has flowed into the second accommodation space S2. Further, this cooling gas flows again into the first accommodation space S1 (space S12) through the opening portion 214*d* of the intermediate wall portion 214 and is discharged to the outside through the ventilation hole portion A formed in the side wall portion 213B. In addition, when passing through the space S12, this cooling gas passes through the space S12 on a surface of the sealing member 53. Therefore, the insulating oil 45 can also be cooled via the sealing member 53.

Figure 3:
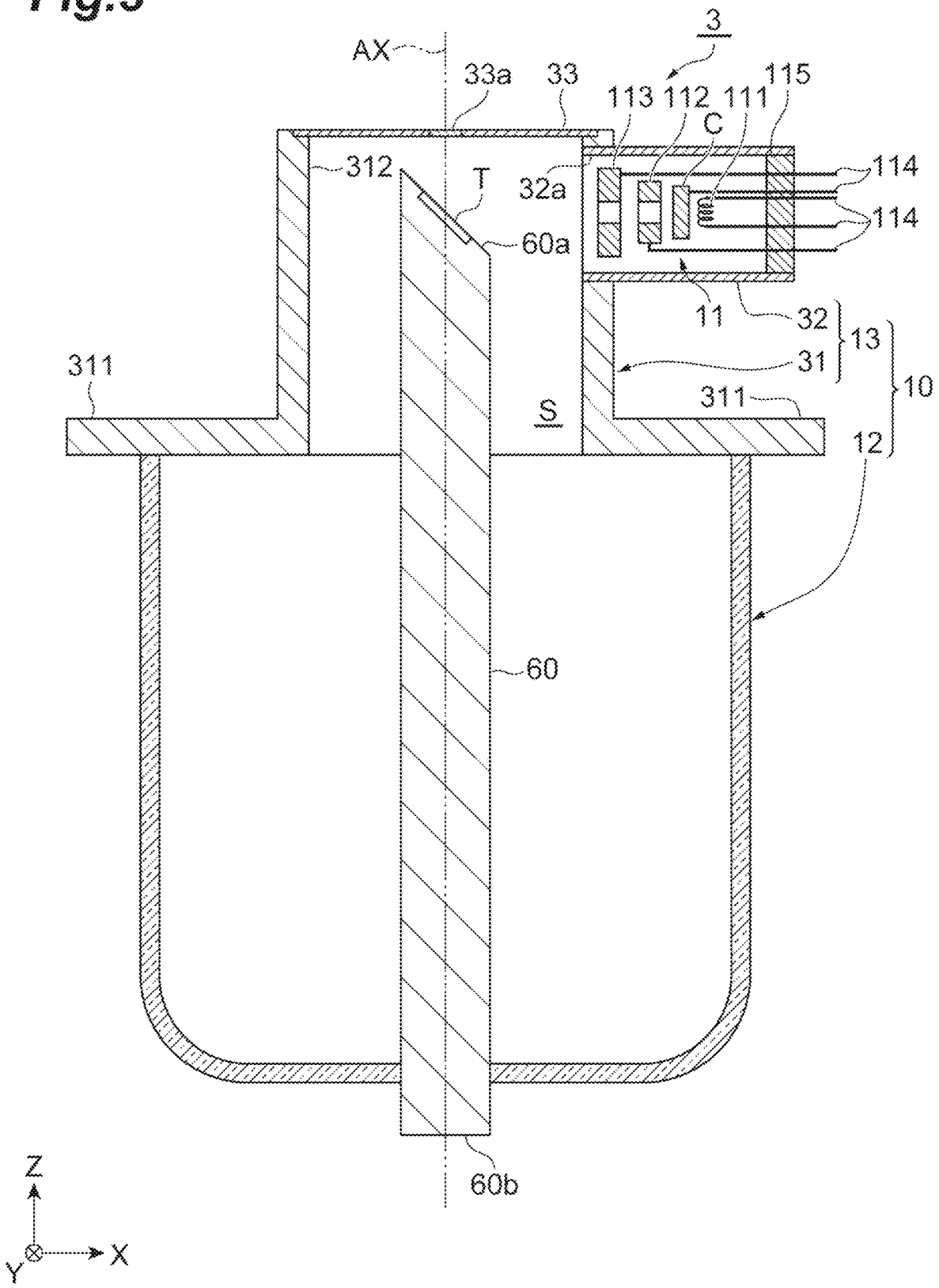
FIG. 3 is a cross-sectional view showing a configuration of an X-ray tube.

Next, a configuration of the X-ray tube 3 will be described. As shown in FIG. 3, the X-ray tube 3 is an X-ray tube which is referred to as a so-called reflection X-ray tube. The X-ray tube 3 includes a vacuum casing 10 serving as a vacuum envelope maintaining the inside in a vacuum state, an electron gun 11 serving as an electron generation unit, and a target T. For example, the electron gun 11 has a cathode C obtained by impregnating a base body made of a metal material or the like having a high-melting point with a substance easily emitting electrons. In addition, for example, the target T is a plate-shaped member made of a metal material having a high-melting point, such as tungsten. The center of the target T is positioned on the tube axis AX of the X-ray tube 3. The electron gun 11 and the target T are accommodated inside the vacuum casing 10, and X-rays are generated when electrons emitted from the electron gun 11 are incident on the target T. X-rays are generated radially from the target T (origin). In components of X-rays toward an X-ray emission window 33*a* side, X-rays drawn out to the outside through the X-ray emission window 33*a* are utilized as required X-rays.

The vacuum casing 10 is mainly constituted of an insulating valve 12 formed of an insulative material (for example, glass), and a metal portion 13 having the X-ray emission window 33*a*. The metal portion 13 has a main body portion 31 in which the target T (anode) is accommodated, and an electron gun accommodation portion 32 in which the electron gun 11 (cathode) is accommodated.

The main body portion 31 is formed to have a tubular shape and has an internal space S. A lid plate 33 having the X-ray emission window 33*a* is fixed to one end portion (outer end portion) of the main body portion 31. The material of the X-ray emission window 33*a* is a radiotranslucent material and is beryllium or aluminum, for example. The lid plate 33 closes one end side of the internal space S. The main body portion 31 has the flange portion 311 and a cylindrical portion 312. The flange portion 311 is provided on the outer circumference of the main body portion 31. The flange portion 311 is apart fixed to the holding portion 41 of the X-ray tube accommodation portion 4 described above. The cylindrical portion 312 is a part formed to have a cylindrical shape on one end portion side of the main body portion 31.

The electron gun accommodation portion 32 is formed to have a cylindrical shape and is fixed to a side portion of the main body portion 31 on one end portion side. The central axis of the main body portion 31 (that is, the tube axis AX of the X-ray tube 3) and the central axis of the electron gun accommodation portion 32 are substantially orthogonal to each other. The inside of the electron gun accommodation portion 32 communicates with the internal space S of the main body portion 31 through an opening 32*a* provided at an end portion of the electron gun accommodation portion 32 on the main body portion 31 side.

The electron gun 11 includes the cathode C, a heater 111, a first grid electrode 112, and a second grid electrode 113, and thereby the diameter of an electron beam generated by cooperation between these configurations can be reduced (micro-focusing can be performed). The cathode C, the heater 111, the first grid electrode 112, and the second grid electrode 113 are attached to a stem substrate 115 through a plurality of power supply pins 114 extending parallel to each other. Power is supplied to each of the cathode C, the heater 111, the first grid electrode 112, and the second grid electrode 113 from the outside through the corresponding power supply pin 114.

The insulating valve 12 is formed to have a substantially tubular shape. One end side of the insulating valve 12 is connected to the main body portion 31. In the insulating valve 12, a target support portion 60 in which the target T is fixed to a tip is held on the other end side thereof. For example, the target support portion 60 is formed of a copper material or the like in a columnar shape and extends in the Z direction. An inclined surface 60*a* inclining away from the electron gun 11 while it goes from the insulating valve 12 side toward the main body portion 31 side is formed on the tip side of the target support portion 60. The target T is embedded in an end portion of the target support portion 60 in a manner of being flush with the inclined surface 60*a*.

A base end portion 60*b* of the target support portion 60 protrudes to the outward side beyond the lower end portion of the insulating valve 12 and is connected to the high-voltage power supply unit 54 of the power source unit 5 (refer to FIG. 2). In the present embodiment, the vacuum casing 10 (metal portion 13) has a ground potential, and the high-voltage power supply unit 54 supplies a high positive voltage to the target support portion 60. However, a form of applying a voltage is not limited to the foregoing example.

Next, with reference to FIGS. 2 and 4, a space enclosing the insulating oil 45 will be described in detail. As shown in FIG. 2, due to an upper surface 51*e* (first surface) of the insulating block 51 and an inner surface 4*a* of the X-ray tube accommodation portion 4 facing the X-ray tube 3, the filling space S3 (first space) enclosing the insulating oil 45 and surrounding a part of the X-ray tube 3 is defined. The upper surface 51*e* is a surface including the upper surface central portion and the upper surface edge portion 51*a* described above. In addition, due to the recess portion 51*c* opening to the outside formed on the side surface 51*b* (second surface) which is a surface of the insulating block 51 different from the upper surface 51*e* and the sealing member 53 sealing the opening of the recess portion 51*c*, a filling space S4 (second space) enclosing the insulating oil 45 is defined. In the present embodiment, the sealing member 53 is attached with an interposition member 53*a* interposed between an edge portion of the sealing member 53 and an opening edge portion of the recess portion 51*c*. More specifically, the interposition member 53*a* is a frame-shaped member surrounding the opening edge portion of the recess portion 51*c* and is fixed to the side surface 51*b* of the insulating block 51 through bonding or the like. Further, in a state in which the sealing member 53 covers an opening portion of the interposition member 53*a*, the edge portion of the sealing member 53 is fixed to the interposition member 53*a* in an attachable/detachable manner using a fixing member 53*b* such as a screw or the like. That is, when fixing the sealing member 53, the fixing member 53*b* such as a screw or the like is not directly inserted into the insulating block 51. If the fixing member 53*b* such as a screw or the like is directly inserted into the insulating block 51, there is a possibility that the fixing member 53*b* may become a foreign substance and discharging may occur between the internal substrate 52 including the high-voltage generation circuit and the fixing member 53*b*. In contrast, since a fixing structure is employed with the interposition member 53*a* therebetween as described above, occurrence of discharging caused by the fixing structure of the sealing member 53 can be curbed. In addition, the sealing member 53 can be fixed in an attachable/detachable manner such that the insulating oil 45 can be replaced or the like. In addition, the sealing member 53 has a hollow shape (a shape of thrusting the insulating oil 45 toward the recess portion 51*c*) toward the recess portion 51*c* from the edge portion fixed by the fixing member 53*b*. Accordingly, when the sealing member 53 is fixed, air bubbles can be prevented from remaining in the insulating oil 45, and the sealing member 53 can be elastically deformed to a greater extent. For this reason, it is possible to extensively cope with a change in volume caused by heat expansion of the insulating oil 45. Depending on the required conditions, the sealing member 53 may be directly fixed to the opening edge portion of the recess portion 51*c* or may be a simple plate-shaped member.

As described above, the communication hole 51*d* (communication portion) causing the filling space S3 and the filling space S4 to communicate with each other is provided in the insulating block 51. In the present embodiment, the communication hole 51*d* is formed to have a cylindrical shape in a height direction (Z direction) of the insulating block 51. The communication hole 51*d* is a penetration hole opening to the upper surface edge portion 51*a* of the insulating block 51 and the side surface of the recess portion 51*c* on the upper surface 51*e* side. Here, the high-voltage power supply unit 54 (connection portion) electrically connecting the X-ray tube 3 and the power source unit 5 to each other is disposed on the upper surface 51*e* of the insulating block 51. In addition, a projecting portion 55 made of an insulative material and protruding in the Z direction (upward direction in FIG. 2) such that the high-voltage power supply unit 54 is surrounded when viewed in the tube axis direction (Z direction) is formed on the upper surface 51*e*. The projecting portion 55 has a function of concealing a boundary part (a part which is likely to become an origin of discharging) between the conductive high-voltage power supply unit 54 and electrically insulating substances of two different kinds (the upper surface 51*e* of the insulating block 51 and the insulating oil 45) from an outer part of the projecting portion 55 when viewed in the Z direction. In the outer part of the projecting portion 55, there is a boundary part between electrically insulating substances (the upper surface 51*e* of the insulating block 51 and the insulating oil 45) and metal parts such as the X-ray tube accommodation portion 4 and the upper wall portion 212 of the accommodation portion 21. Discharging from the high-voltage power supply unit 54 is likely to head for this boundary part. However, since the projecting portion 55 is provided, this boundary part can be prevented from being directly seen from the high-voltage power supply unit 54, and thus discharging can be curbed. Further, an opening of the communication hole 51*d* on the upper surface 51*e* side is provided on the outward side of the projecting portion 55 when viewed in the Z direction. Accordingly, the opening of the communication hole 51*d* on the upper surface 51*e* side is concealed by the projecting portion 55 such that it is prevented from being directly seen from the high-voltage power supply unit 54. In the present embodiment, the projecting portion 55 is a part of the upper surface 51*e* of the insulating block 51 but may be formed using an electrically insulating member different from the insulating block 51.

Figure 4:
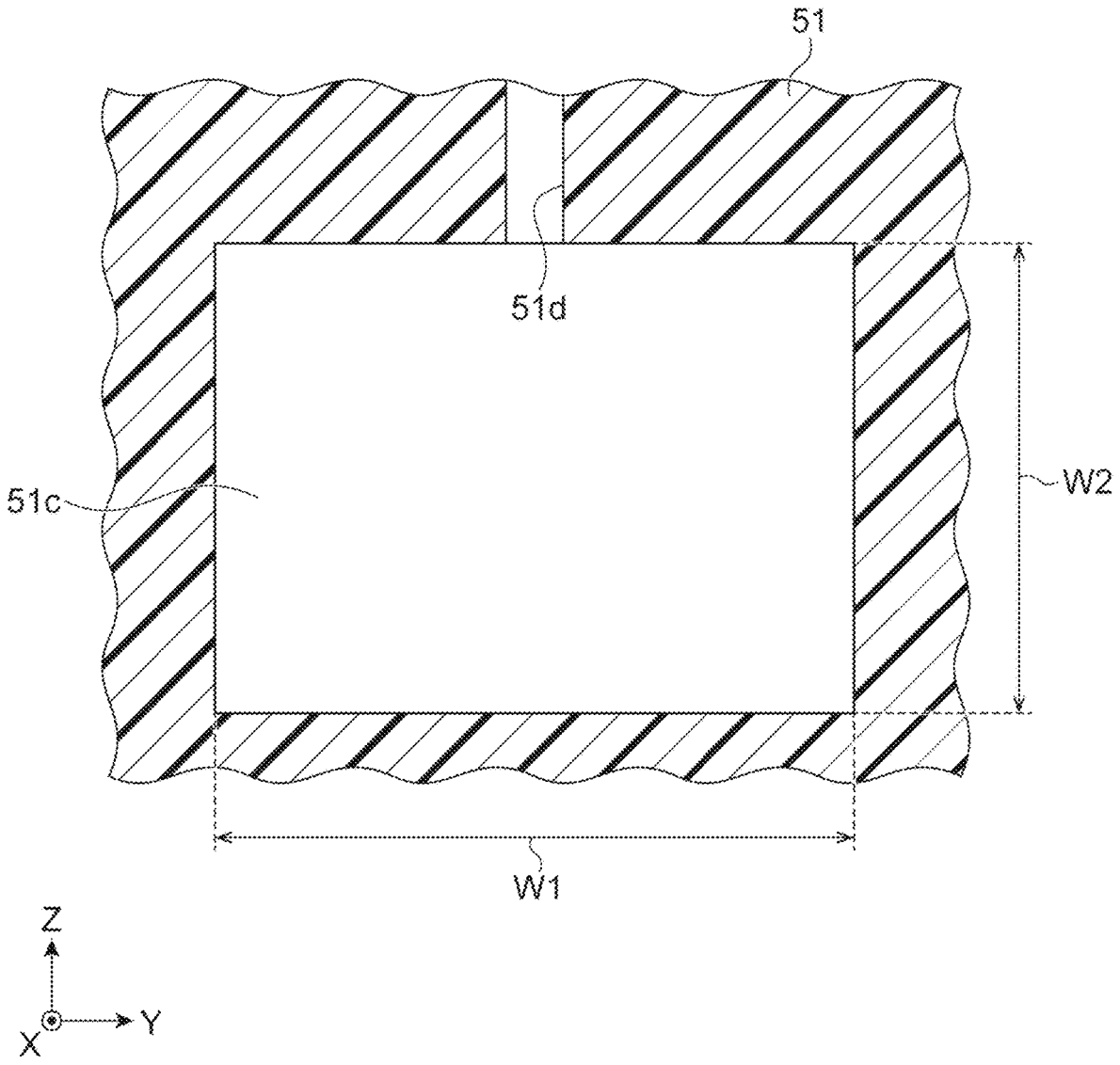
FIG. 4 is a cross-sectional view of an insulating block in a YZ plane along a communication hole.

FIG. 4 is a cross-sectional view of the insulating block 51 in a YZ plane along the communication hole 51*d*. As shown in FIG. 4, the shape of the recess portion 51*c* (that is, the shape of an opening surface of the recess portion 51*c*) viewed in a direction (X direction) facing the recess portion 51*c* is a rectangular shape. In the present embodiment, as an example, the opening surface of the recess portion 51*c* is formed to have a rectangular shape in which a direction extending in the Y direction is a longitudinal direction and a direction extending in the Z direction is a short direction. That is, a width w1 of the opening surface of the recess portion 51*c* in the Y direction is wider than a width w2 of the opening surface of the recess portion 51*c* in the Z direction (w1>w2). In addition, in the present embodiment, as an example, the communication hole 51*d* opens in a central upper portion of the recess portion 51*c* when viewed in the X direction, but the position of the opening of the communication hole 51*d* on the recess portion 51*c* side is not limited thereto. For example, the opening of the communication hole 51*d* on the recess portion 51*c* side may be provided at a position where it becomes flush with the side surface of the recess portion 51*c* (in the example of FIG. 4, one of a pair of side surfaces facing each other in the Y direction). In addition, a plurality of communication holes 51*d* may be provided between the upper surface edge portion 51*a* and the recess portion 51*c*.

A depth d (refer to FIG. 2) which is the length of the recess portion 51*c* (a distance between the side surface 51*b* and a bottom surface of the recess portion 51*c*) in a depth direction (X direction) is smaller than the width w1 of the recess portion 51*c* in the longitudinal direction (in the present embodiment, the Y direction) orthogonal to this depth direction. In addition, in the present embodiment, the depth d is smaller than the width w2 of the recess portion 51*c* in the short direction (in the present embodiment, the Z direction). That is, "w1>w2>d" is established.

[Effects]

Next, effects according to the aspect of the present embodiment will be described. As described above, the X-ray generator 1 includes the X-ray tube 3 generating X-rays, the X-ray tube accommodation portion 4 accommodating at least a part of the X-ray tube 3 (in the present embodiment, a part positioned below the flange portion 311, that is, a part including at least the insulating valve 12) such that at least the part of the X-ray tube 3 is surrounded when viewed in the tube axis direction (Z direction) of the X-ray tube 3, and the power source unit 5 disposed at a position facing the X-ray tube 3 in the tube axis direction and having the internal substrate 52 supplying a voltage to the X-ray tube 3 sealed inside the solid insulating block 51 made of an insulative material. The filling space S3 is defined by the upper surface 51*e* of the insulating block 51 and the inner surface 4*a* of the X-ray tube accommodation portion 4. The filling space S4 is defined by the recess portion 51*c* opening to the outside formed on the side surface 51*b* of the insulating block 51 and the sealing member 53 sealing the opening of the recess portion 51*c*. The communication hole 51*d* causing the filling space S3 and the filling space S4 to communicate with each other is provided in the insulating block 51. The insulating oil 45 is enclosed in the filling space S3 and the filling space S4. The depth d of the recess portion 51*c* is smaller than the width w1 of the recess portion 51*c* in the longitudinal direction (in the present embodiment, the Y direction) orthogonal to the depth direction (Z direction) of the recess portion 51*c*.

In the X-ray generator 1 described above, the insulating block 51 includes the filling space S4 defined by the recess portion 51*c* opening to the outside formed on the side surface 51*b* different from the upper surface 51*e* defining the filling space S3, and the filling space S4 communicates with the filling space S3 through the communication hole 51*d*. Accordingly, the filling space S3 and the filling space S4 filled with the insulating oil 45 open in the region (filling space S4) not facing the X-ray tube accommodation portion 4. Thus, in the recess portion 51*c* (filling space S4), a configuration (in the present embodiment, a diaphragm made of the sealing member 53) for improving and/or retaining insulating characteristics or heat dissipation characteristics of the insulating oil 45 can be disposed. Therefore, occurrence of disturbance in an electric field inside the X-ray tube accommodation portion 4 (filling space S3) due to this configuration can be curbed, and discharging caused by this disturbance in an electric field can be curbed. For instance, when such an opening portion is provided in the X-ray tube accommodation portion 4 (filling space S3) made of a metal (conductive material), disturbance occurs in an electric field in this opening portion, and this disturbance in an electric field may cause discharging. In addition, the communication hole 51*d* and the opening of the recess portion 51*c* also function as opening portions for enclosing the insulating oil 45 in the filling space S4. For example, air bubbles in the insulating oil 45 which may cause an insulation breakdown can also be removed by connecting a vacuum pump to these openings after filling is performed with the insulating oil 45 through the opening of the recess portion 51*c*.

In addition, since the insulating oil 45 filling the filling space S3 and the filling space S4 comes into direct contact with the X-ray tube 3, it is exposed to a state at a high temperature. In addition, there is concern that foreign substances or the like (for example, metal pieces or the like which have peeled off from a part of the target support portion 60) may be incorporated into the insulating oil 45. Due to such causes, insulating properties of the insulating oil 45 are more likely to deteriorate than those of the solid insulating block 51. In this manner, if the distance between the space (filling space S4) inside the recess portion 51*c* filled with a liquid of which insulating properties are likely to deteriorate and the internal substrate 52 is short, there is a high degree of concern that voltage endurance characteristics of the insulating block 51 to the filling space S4 side with respect to a high voltage generated by the internal substrate 52 may deteriorate and discharging may occur toward the filling space S4 side. Meanwhile, in the X-ray generator 1, the depth d of the recess portion 51*c* is smaller than the width w1 of the recess portion 51*c* in the longitudinal direction (Y direction). That is, the shape of the recess portion 51*c* is a flat shape. Accordingly, the distance between the internal substrate 52 sealed inside the insulating block 51 and the filling space S4 can be secured as long as possible. That is, the thickness of the solid insulating block 51 interposed between the internal substrate 52 and the filling space S4 can be secured as thick as possible. As a result, occurrence of discharging described above can also be curbed effectively.

In addition, on the upper surface 51*e* of the insulating block 51, the high-voltage power supply unit 54 electrically connecting the X-ray tube 3 and the power source unit 5 to each other is disposed, and the projecting portion 55 is formed. The opening of the communication hole 51*d* on the upper surface 51*e* side is provided on the outward side of the projecting portion 55 when viewed in the tube axis direction (Z direction). In this case, due to the projecting portion 55, the opening of the communication hole 51*d* on the upper surface 51*e* side which may cause disturbance in an electric field can be isolated from the high-voltage power supply unit 54 (particularly, the boundary part between the high-voltage power supply unit 54 and the upper surface 51*e*) which is likely to become an origin of discharging. As a result, occurrence of discharging in this opening can be curbed effectively.

In addition, the opening surface of the recess portion 51*c* has a rectangular shape (refer to FIG. 4). The depth d of the recess portion 51*c* is smaller than the length of any side of the opening surface (the width w1 and the width w2). In this configuration, while the depth d of the recess portion 51*c* can be as shallow as possible, the volume required for the filling space S4 can be ensured by increasing the area (w1×w2) of the opening surface as much as possible. In addition, since the area (w1×w2) of the opening surface can be increased, heat dissipation of the insulating oil 45 through the opening portion can be improved.

In addition, the sealing member 53 is a member capable of being deformed in accordance with a change in volume of the insulating oil 45 enclosed in the filling space S3 and the filling space S4. As described above, in the present embodiment, as an example, the sealing member 53 is a lid member made of an insulative material capable of being elastically deformed and functions as a diaphragm. According to this configuration, a change in volume (expansion or contraction) caused by a change in temperature of the insulating oil 45 can be absorbed through deformation of the sealing member 53. Accordingly, a change in internal pressure inside the filling space S3 in which the X-ray tube 3 is accommodated can be curbed. The sealing member 53 having such a function is not limited to the diaphragm described above. For example, it may be configured to include bellows, a damper, or the like.

Hereinabove, the embodiment of the present disclosure has been described. However, the present disclosure is not limited to the foregoing embodiment, and the present disclosure can be subjected to various deformations within a range not departing from the gist thereof. That is, the shape, the material, and the like of each of the units and the portions of the X-ray generator are not limited to specific shapes, materials, and the like described in the foregoing embodiment.

In the foregoing embodiment, the opening of the communication hole 51*d* on the upper surface 51*e* side is provided on the outward side of the projecting portion 55 when viewed in the Z direction, but this opening may be provided on the inward side of the projecting portion 55 when viewed in the Z direction. In addition, in the foregoing embodiment, the shape of the opening of the recess portion 51*c* is a rectangular shape (refer to FIG. 4). However, the shape of the opening of the recess portion 51*c* is not limited thereto. For example, it may be a circular shape, an elliptical shape, or the like.

Figure 5:
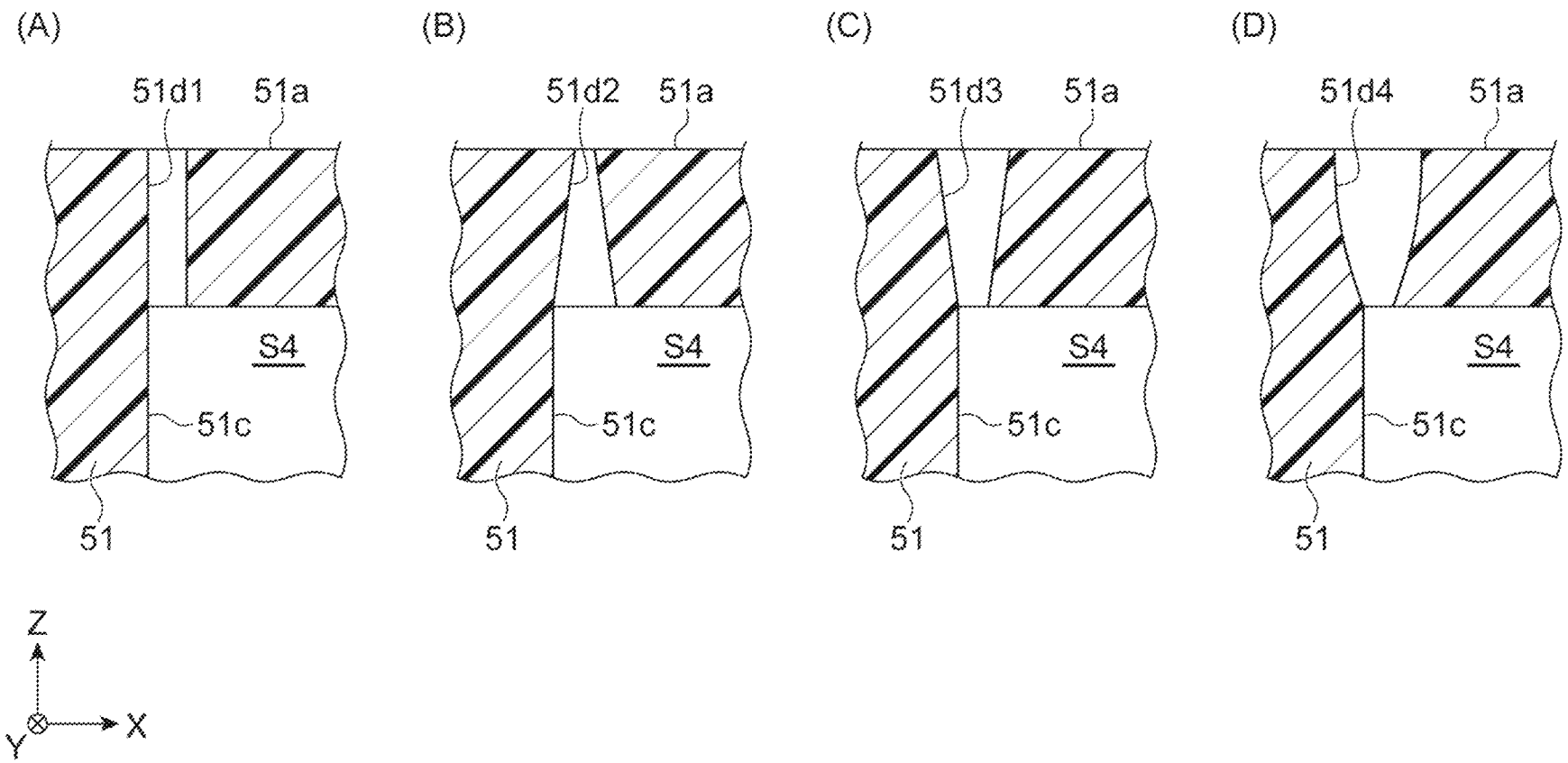
FIG. 5 is a view showing modification examples of the communication hole.

In addition, a communication hole formed in the insulating block 51 is not limited to that including only a part extending in a linear shape as in the present embodiment and may include a part (a curved part or the like) extending in a curved shape. In addition, the shape of this communication hole is not limited to a columnar shape described in the foregoing embodiment. FIG. 5 is a view showing several modification examples of the communication hole 51*d*.

As shown in (A) of FIG. 5, the bottom surface of the recess portion 51*c* may be connected in a manner of being flush with at least a part on an inner surface of a communication hole 51*d*1 in the opening of the communication hole 51*d*1 on the recess portion 51*c* side. According to this configuration, circulation of the insulating oil 45 between the communication hole 51*d*1 and the filling space S4 can be smoothened. Specifically, when the filling space S3 is filled with the insulating oil 45, in a case in which the insulating oil 45 is injected into the recess portion 51*c*, or the like, in a state in which the opening surface of the recess portion 51*c* is on an upper side, the insulating oil 45 easily flows into the communication hole 51*d*1 from the filling space S4. Accordingly, the filling space S3 can be filled with the insulating oil 45 more smoothly.

As a communication hole 51*d*2 shown in (B) of FIG. 5, the communication hole may be formed to have a tapered shape which increases in diameter closer to the filling space S4 in the tube axis direction (Z direction). According to this configuration, when air bubbles are removed from the filling space S3 and the filling space S4 by connecting a vacuum pump to this opening after the insulating oil 45 is injected into the filling space S3 and the filling space S4 through the opening of the recess portion 51*c*, the suctioning side (recess portion 51*c* side) of the communication hole 51*d*2 has a wider width. Accordingly, there is an advantage that air bubbles are easily removed (air bubbles are unlikely to stay inside the communication hole 51*d*2).

As a communication hole 51*d*3 shown in (c) of FIG. 5, the communication hole may be formed to have a tapered shape which decreases in diameter closer to the filling space S4 in the tube axis direction (Z direction). According to this configuration, a liquid easily flows from the filling space S4 side to the upper surface 51*e* side (filling space S4 side). Therefore, the insulating oil 45 can be injected smoothly into the filling space S3.

As a communication hole 51*d*4 shown in (D) of FIG. 5, the communication hole may be formed by causing an inner surface of the communication hole 51*d*3 described above to have a curved surface shape (R shape). Similarly, the communication hole may be formed by causing an inner surface of the communication hole 51*d*2 described above to have a curved surface shape (R shape). According to this configuration, the communication hole 51*d*4 has an increased internal space even with the same opening diameter. Therefore, the insulating oil 45 can be injected smoothly.

Figure 6:
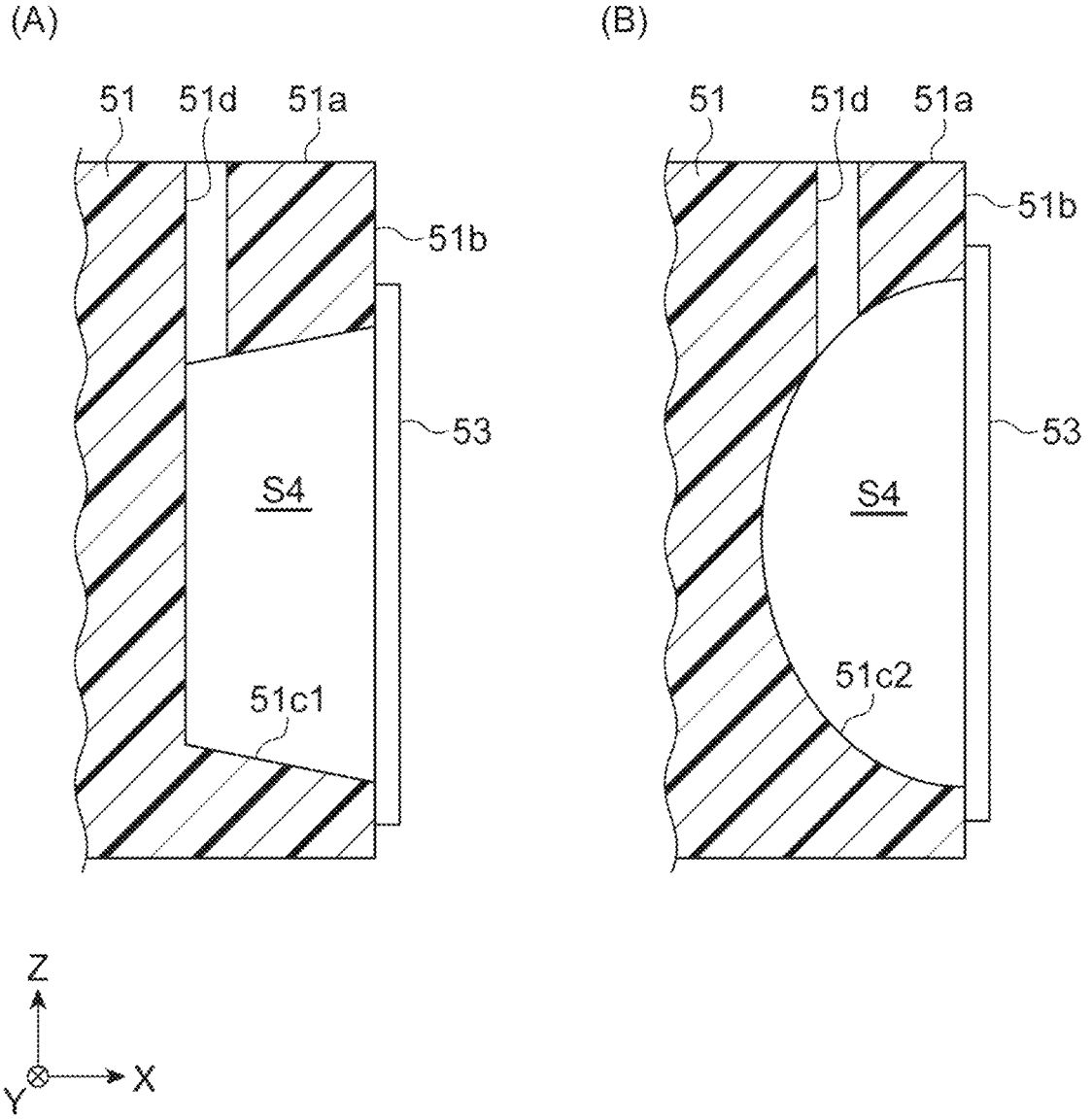
FIG. 6 is a view showing modification examples of a recess portion formed in the insulating block.

In addition, the shape of the recess portion 51*c* (the shape of the space formed by the recess portion 51*c*) is not limited to the rectangular parallelepiped shape described in the foregoing embodiment. FIG. 6 is a view showing modification examples of the recess portion 51*c*.

As a recess portion 51*c*1 shown in (A) of FIG. 6, the recess portion formed in the insulating block 51 may have a truncated cone shape (in this example, a truncated quadrangular pyramid shape) expanding from the bottom surface side of the recess portion toward the opening side. In addition, as a recess portion 51*c*2 shown in (B) of FIG. 6, the recess portion formed in the insulating block 51 may have a hemispherical shape or a semi-elliptical sphere shape.

Figure 7:
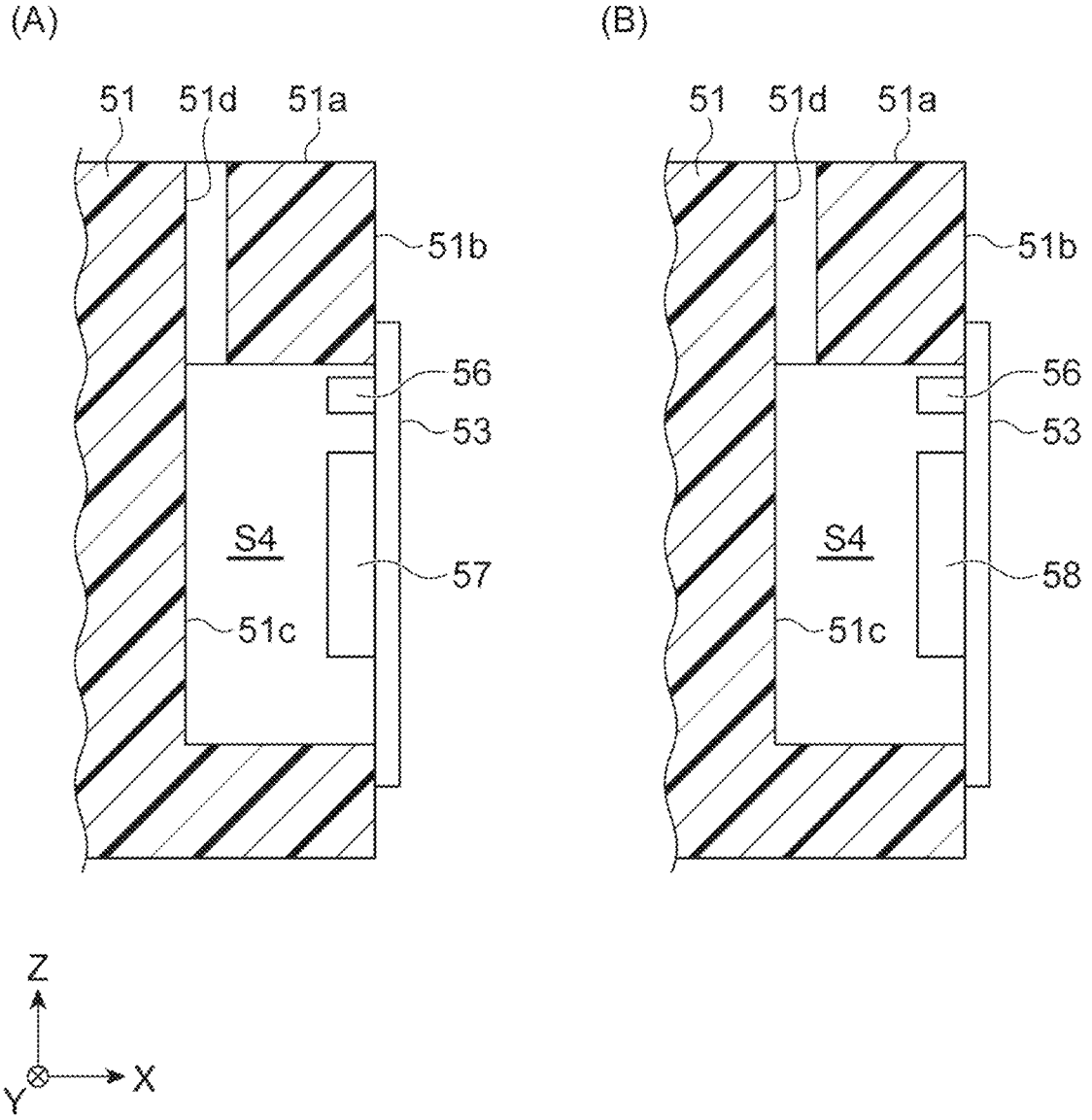
FIG. 7 is a view showing a modification example of the X-ray generator.

In addition, as shown in FIG. 7, as a configuration for improving and/or retaining insulating characteristics or heat dissipation characteristics of the insulating oil 45, a sensor 56 measuring the temperature of the insulating oil 45 may be disposed in the filling space S4. For example, the sensor 56 may be provided on an inner surface of the sealing member 53. In this case, it is preferable that the sealing member 53 be a substrate having a rigidity to an extent that it is not affected by a change in oil pressure. For example, the temperature measured by the sensor 56 may be displayed by a monitor or the like connected to an external terminal (not shown in the diagram) of the X-ray generator 1. According to this configuration, the temperature of the insulating oil 45 can be measured by the sensor 56, the temperature of the insulating oil 45 is easily managed. In addition, cooling or heating of the insulating oil 45 can also be controlled appropriately by a cooling unit 57 or a heating unit 58 (which will be described below) such that the temperature of the insulating oil 45 is maintained at a certain target temperature. For example, the control circuit mounted on the control circuit substrate 7 may acquire measure results of the sensor 56 and control operation of the cooling unit 57 or the heating unit 58 in accordance with these measurement result to perform temperature control as described above.

As shown in (A) of FIG. 7, as a configuration for improving and/or retaining insulating characteristics or heat dissipation characteristics of the insulating oil 45, the cooling unit 57 for cooling the insulating oil 45 may be disposed in the filling space S4. For example, the cooling unit 57 is a heatsink or the like integrated with the sealing member 53. According to this configuration, the insulating oil 45 at a high temperature can be cooled efficiently by the cooling unit 57 by absorbing heat from the X-ray tube 3 and the like (for example, a part of the target support portion 60 exposed to the outward side of the insulating valve 12).

As shown in (B) of FIG. 7, as a configuration for improving and/or retaining insulating characteristics or heat dissipation characteristics of the insulating oil 45, the heating unit 58 for heating the insulating oil 45 may be disposed in the filling space S4. For example, the heating unit 58 is a heater or the like integrated with the sealing member 53. According to this configuration, when it is desired that the temperature of the insulating oil 45 be raised to a certain temperature, or the like, in order to stabilize operation of the X-ray tube 3 at the time of starting the X-ray generator 1 or the like, the insulating oil 45 can be heated efficiently by the heating unit 58.

Figure 8:
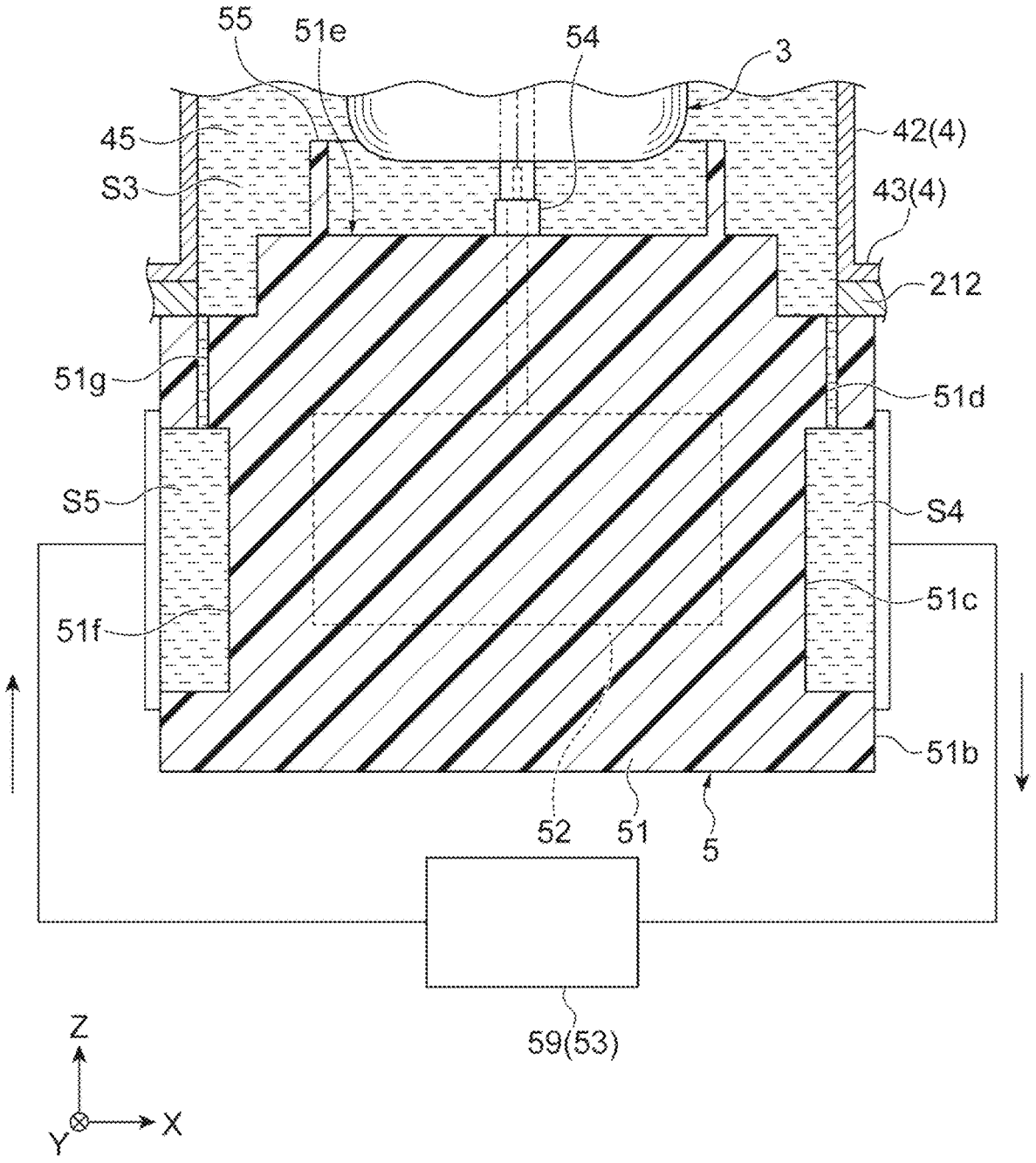
FIG. 8 is a view showing the modification example of the X-ray generator.

In addition, as shown in FIG. 8, a second recess portion 51*f* different from the recess portion 51*c* opening to the outside may be formed on a surface different from the upper surface 51*e* of the insulating block 51. In this example, the second recess portion 51*f* having a shape similar to that of the recess portion 51*c* is provided on the side surface opposite to the side surface 51*b*, but the second recess portion 51*f* may be provided in a part where the recess portion 51*c* on the side surface 51*b* is not formed. That is, two independent recess portions may be formed on the same surface (a surface other than the upper surface 51*e*) of the insulating block 51.

In addition, in the example of FIG. 8, a second communication hole 51*g* (second communication portion) causing a filling space S5 defined by the second recess portion 51*f* and the filling space S3 to communicate with each other is provided in the insulating block 51. Further, as a configuration for improving and/or retaining insulating characteristics or heat dissipation characteristics of the insulating oil 45, a circulation pump 59 functions as the sealing member 53. The circulation pump 59 is configured to seal the opening of the recess portion 51*c*, seal the opening of the second recess portion 51*f*, and discharge the insulating oil 45 suctioned from one of the recess portion 51*c* and the second recess portion 51*f* (here, the recess portion 51*c* as an example) to the other of the recess portion 51*c* and the second recess portion 51*f* (here, the second recess portion 51*f*). According to such a configuration, the insulating oil 45 can circulate between the circulation pump 59 and the filling space S3. Specifically, in the foregoing example, the insulating oil 45 circulates in the order of "the filling space S3, the filling space S4, the circulation pump 59, the filling space S5, and the filling space S3". Accordingly, cooling efficiency of the X-ray tube 3 (mainly, a part of the target support portion 60 exposed to the outward side of the insulating valve 12) can be improved by generating a convective flow of the insulating oil 45 inside the filling space S3. Moreover, cooling or heating of the insulating oil 45 may be performed in the circulation pump 59. In this case, it is easy to perform control such that the temperature of the insulating oil 45 inside the filling space S3 is maintained to be uniform at a target temperature. In addition, for example, as shown in (B) to (D) of FIG. 5, the communication hole 51*d* and the second communication hole 51*g* may be formed such that the width of a flow channel increases while it goes toward the downstream side from the upstream side of a circulation path of the insulating oil 45. Accordingly, circulation of the insulating oil 45 can be smoothened.

In addition, in the foregoing embodiment, the recess portion 51*c* and the filling space S4 are provided on the side surface of the insulating block 51 but may be provided on a lower surface of the insulating block 51. For example, a recess portion and a filling space can be formed on the lower surface of the insulating block 51 by providing an opening facing the lower surface of the insulating block 51 in the intermediate wall portion 214 and disposing the control circuit substrate 7 at a position different from a position below the insulating block 51. In addition, the X-ray tube 3 is a reflection X-ray tube drawing out X-rays in a direction different from an electron incidence direction with respect to a target, but it may be a transmission X-ray tube drawing out X-rays in the electron incidence direction with respect to a target (in which X-rays generated in a target are transmitted through the target itself and are drawn out through an X-ray emission window). In addition, the blower fan 9 is not limited to that blowing gas from the outside to the inside (into the casing 2) and may be a suctioning fan circulating gas by suctioning out gas from the inside to the outside.

REFERENCE SIGNS LIST

1 X-ray generator
3 X-ray tube
4 X-ray tube accommodation portion
5 Power source unit
45 Insulating oil (insulating liquid)
51 Insulating block
51*b* Side surface (second surface)
51*c*, 51*c*, 51*c*2 Recess portion
51*d*, 51*d*1, 51*d*2, 51*d*3, 51*d*4 Communication hole (communication portion)
51*e* Upper surface (first surface)
51*f* Second recess portion
51*g* Second communication hole (second communication portion)
52 Internal substrate (high-voltage generation circuit)
53 Sealing member
54 High-voltage power supply unit (connection portion)
55 Projected portion
56 Sensor
57 Cooling unit
58 Heating unit
59 Circulation pump
AX Tube axis
d Depth
S3 Filling space (first space)
S4 Filling space (second space)
S5 Filling space (filling space defined by second recess portion)
w1, w2 Width

The invention claimed is:

1. An X-ray generator comprising:

an X-ray tube configured to generate X-rays;

an X-ray tube accommodation portion which accommodates at least a part of the X-ray tube such that at least the part of the X-ray tube is surrounded when viewed in a tube axis direction of the X-ray tube; and a power source unit disposed at a position facing the X-ray tube in the tube axis direction and having a high-voltage generation circuit supplying a voltage to the X-ray tube sealed inside a solid insulating block made of an insulative material, wherein a first space is defined by a first surface of the insulating block facing the X-ray tube and an inner surface of the X-ray tube accommodation portion, wherein a second space is defined by a recess portion opening to an outside formed on a second surface of the insulating block different from the first surface and a sealing member sealing an opening of the recess portion, wherein a communication portion causing the first space and the second space to communicate with each other is provided in the insulating block, wherein an insulating liquid is enclosed in the first space and the second space, and wherein a depth of the recess portion is smaller than a width of the recess portion in a longitudinal direction orthogonal to a depth direction of the recess portion.

2. The X-ray generator according to claim 1, wherein the communication portion is a communication hole formed inside the insulating block in a manner of opening to the first surface and the recess portion.

3. The X-ray generator according to claim 1, wherein on the first surface of the insulating block, a connection portion electrically connecting the X-ray tube and the power source unit to each other is disposed, and a projecting portion made of an insulative material and protruding in the tube axis direction such that the connection portion is surrounded when viewed in the tube axis direction is formed, and wherein an opening of the communication portion on the first surface side is provided on an outward side of the projecting portion when viewed in the tube axis direction.

4. The X-ray generator according to claim 1, wherein an opening surface of the recess portion has a rectangular shape, and wherein the depth of the recess portion is smaller than a length of any side of the opening surface.

5. The X-ray generator according to claim 1, wherein the sealing member is a member capable of being deformed in accordance with a change in volume of the insulating liquid enclosed in the first space and the second space.

6. The X-ray generator according to claim 1, wherein a cooling unit for cooling the insulating liquid is disposed in the second space.

7. The X-ray generator according to claim 1, wherein a heating unit for heating the insulating liquid is disposed in the second space.

8. The X-ray generator according to claim 1, wherein a sensor measuring a temperature of the insulating liquid is disposed in the second space.

9. The X-ray generator according to claim 1, wherein a second recess portion different from the recess portion opening to the outside is formed on a surface different from the first surface of the insulating block, wherein a second communication portion causing a space defined by the second recess portion and the first space to communicate with each other is provided in the insulating block, and wherein the sealing member is a circulation pump configured to seal the opening of the recess portion, seal an opening of the second recess portion, and discharge the insulating liquid suctioned from one of the recess portion and the second recess portion to the other of the recess portion and the second recess portion.

* * * * *